US005890469A

United States Patent [19]

Håkansson et al.

[11] Patent Number: 5,890,469

[45] Date of Patent: Apr. 6, 1999

[54] EXHAUST VALVE MECHANISM IN AN INTERNAL COMBUSTION ENGINE

[75] Inventors: Nils Olof Håkansson, Stenkullen; Per Persson, Partille, both of Sweden

[73] Assignee: AB Volvo, Gothenburg, Sweden

[21] Appl. No.: 913,721

[22] PCT Filed: Mar. 19, 1996

[86] PCT No.: PCT/SE96/00346

§ 371 Date: Nov. 18, 1997

§ 102(e) Date: Nov. 18, 1997

[87] PCT Pub. No.: WO96/29508

PCT Pub. Date: Sep. 26, 1996

[30] Foreign Application Priority Data

Mar. 20, 1995 [SE] Sweden ..... 9500965

[51] Int. Cl.[6] ..... F01L 13/06; F01L 1/24; F02D 13/04

[52] U.S. Cl. ..... 123/321; 123/90.16; 123/90.46

[58] Field of Search ..... 123/90.15, 90.16, 123/90.17, 90.39, 90.46, 320, 321

[56] References Cited

U.S. PATENT DOCUMENTS

| | | | |
|---|---|---|---|
| 3,809,033 | 5/1974 | Cartledge | 123/90.46 |
| 5,193,497 | 3/1993 | Hakansson | 123/90.16 |
| 5,564,385 | 10/1996 | Hakansson | 123/321 |

FOREIGN PATENT DOCUMENTS

WO 94/25740 11/1994 WIPO .

*Primary Examiner*—Weilun Lo
*Attorney, Agent, or Firm*—Young & Thompson

[57] ABSTRACT

Exhaust valve mechanism in an internal combustion engine, comprising a valve play take-up mechanism in the form of a piston (8) disposed in a cylinder chamber (7) at one end of a rocker arm (1) and a hydraulic circuit with valve means (20) for supplying and draining oil to and from the cylinder chamber. Controlled check valve means (22) prevent, at a certain pressure in the hydraulic circuit, drainage of oil from the cylinder chamber. A bypass valve (40) controlled by the rocking movement of the rocker arm opens for draining the cylinder chamber before the exhaust valve reaches the top of its lift curve.

5 Claims, 4 Drawing Sheets

EXHAUST VALVE MECHANISM IN AN INTERNAL COMBUSTION ENGINE

BACKGROUND OF THE INVENTION

The present invention relates to an exhaust valve mechanism in an internal combustion engine, comprising at least one exhaust valve in each cylinder, for each cylinder a rocker arm mounted on a rocker arm shaft for operating the exhaust valve, a cam shaft with a cam element for each rocker arm, said cam element cooperating with a cam follower at one end of the rocker arm, a valve play take-up device arranged between an opposite end of the rocker aim and the exhaust valve, said valve play take-up device comprising a piston element received in a cylinder chamber disposed in said opposite rocker arm end, and a hydraulic circuit with valve means for supplying or draining hydraulic oil to and from said cylinder chamber, said valve means comprising a controlled check valve, which at a certain low pressure permits flow of hydraulic oil from the cylinder chamber.

SE-A-468 132 reveals as previously known an exhaust mechanism of the above mentioned type which, together with a special type of cam shaft with extra cam lobes can be used to increase the braking power of the engine. The extra cam lobes are dimensioned in this case so that their lift approximately corresponds to the normal valve play of the valve mechanism. By reducing the valve play to zero by means of the valve play take-up mechanism it is possible to obtain an extra lift during a suitable time interval of the exhaust valve, corresponding to the normal valve play. For example, an extra cam lobe can be so placed relative to the ordinary cam lobe that an extra exhaust valve lift is obtained during the latter portion of the compression stroke, resulting in a portion of the compression work during the compression stroke being lost and not being recoverable during the expansion stroke. The result will be that the braking power of the engine increases.

An engine with such an arrangement for increasing the braking effect will, however, have a somewhat lower efficiency than a corresponding conventional engine. This is because the maximum exhaust valve lift and the latest possible exhaust valve closing at zero valve play is utilized for braking operation and not for drive mode, which means that during drive mode a lower valve lift is obtained when the valve play take-up device is not activated, which also means that the exhaust valves will close earlier than if maximum lift can be used in drive mode.

The purpose of the present invention is to achieve an exhaust valve mechanism of the type described by way of introduction, in which the exhaust valve lift curve can be allowed to be the same for drive mode and braking mode, at least in the vicinity of closing.

This is achieved according to the invention by virtue of the fact that the valve means comprise valve means controlled relative to the rocking movement of the rocker arm said valve means being disposed after a certain rocking movement, to open a communication past the check valve to permit drainage of the cylinder chamber.

The lift curve in the vicinity of closing of the exhaust valves is determined by the available space in the combustion chamber with the piston in the upper dead center position. So that the exhaust valves will not hit the pistons during braking mode, according to the invention a rocker movement controlled bypass valve is used which permits such rapid emptying of the cylinder chamber of the valve play take-up piston that the piston will be in its retracted position when the rocker arm cam follower is lying on the regular cam lobe on its latter portion. This means that the valve closes at the same location on the lift curve during braking mode and during drive mode. After closing of the exhaust valve and subsequent closing of the bypass valve, the valve play take-up piston is again activated by supplying oil under pressure to the piston cylinder chamber via the one-way valve as long as the pressure in the hydraulic circuit maintains the blocking function of the one-way valve. In contrast to the known valve mechanism disclosed in the introduction, the cylinder chamber of the valve play take-up piston is filled and emptied once per cycle in braking mode.

In a preferred embodiment of the valve mechanism according to the invention, the bypass valve is formed by a valve slide, which is rotatably mounted in the rocker arm and which has a gear rim in engagement with a gear section fixed relative to the rocker arm shaft. The slide is made with a groove, which in one position of the slide permits draining of the cylinder chamber past the one-way valve.

BRIEF DESCRIPTION OF THE DRAWINGS

The invention will be described in more detail below with reference to examples shown in the accompanying drawings, where.

DESCRIPTION OF THE PREFERRED EMBODIMENTS

Figure 1:
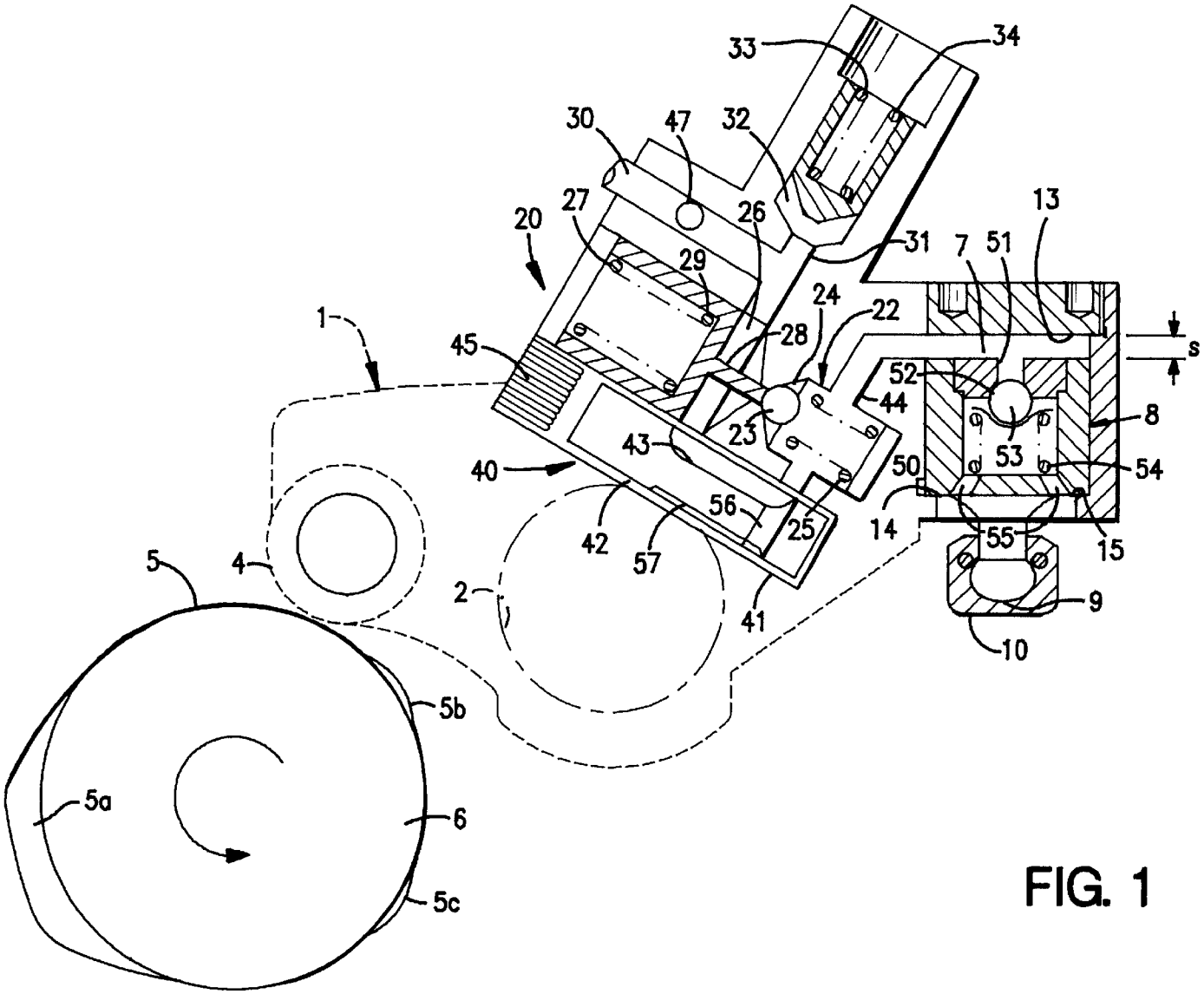
FIG. 1 shows the principle of one embodiment of a rocker arm included in an exhaust valve mechanism according to the invention.
Figure 2:
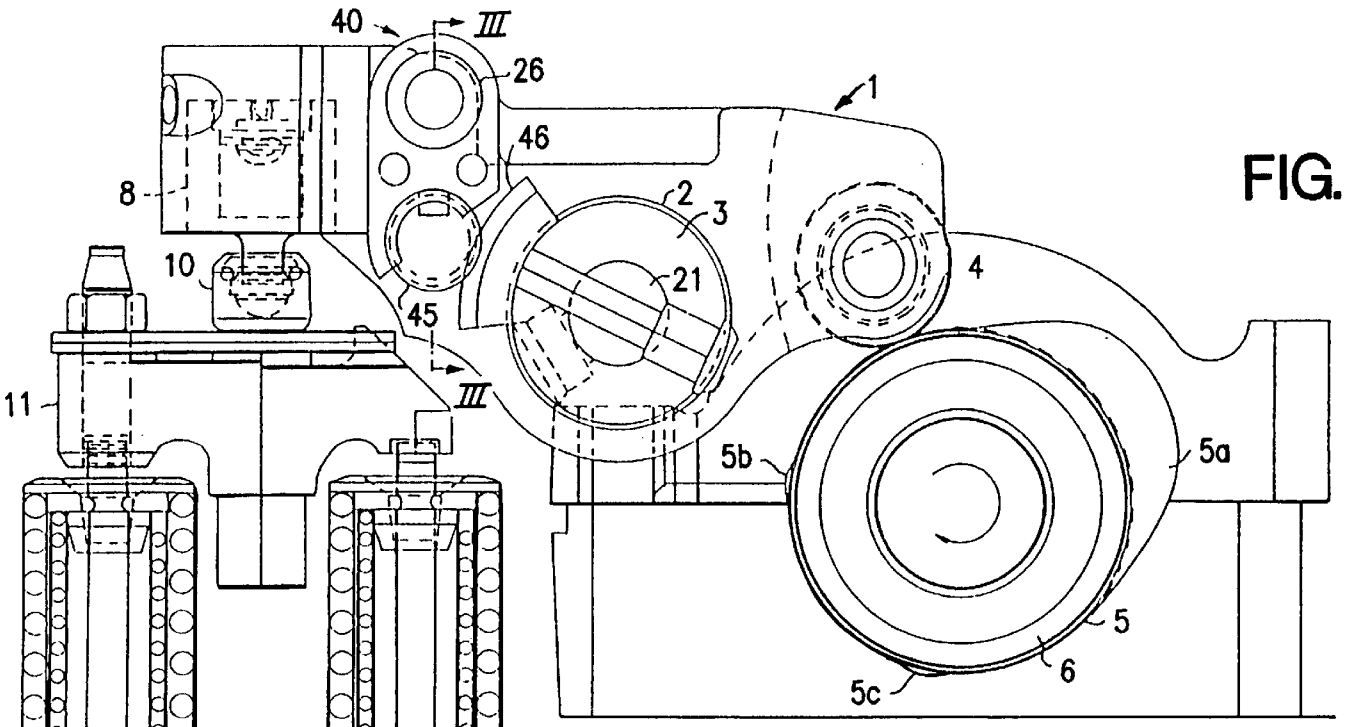
FIG. 2 is a sideview of a preferred design of an exhaust valve mechanism according to the invention.

In FIGS. 1 and 2, 1 designates a rocker arm with a bore 2 for mounting the rocker arm on a rocker arm shaft 3. At its end, the rocker arm 1 is provided with a cam follower in the form of a rotatably mounted roller 4, which in cooperation with a cam element 5 on the cam shaft 6 imparts in a known manner a rocking motion to the rocker arm. At its opposite end, the rocker arm is provided with a cylinder chamber 7 in which a piston element 8 is slidably mounted. The piston element 8 is provided at its distal end with a ball 9, which is housed in a spherical socket in a holder 10, which rests on a yoke 11 interconnecting the valve spindles 12 of a pair of exhaust valves in an engine cylinder (not shown). The piston element 8 can be moved between a retracted end position in which its upper surface is in contact with the bottom surface 13 of the cylinder chamber 7 and an extended end position, in which its outer edge 14 abuts against an annular abutment surface 15 of the cylinder chamber. The length of stroke "S" of the piston element 8 can be up to circa 2 mm. By supplying or draining hydraulic oil to or from the cylinder chamber 7, the lift of the exhaust valves 12 can be varied by the distance "S".

The cylinder chamber 7 communicates via a valve arrangement (generally designated 20) housed in the rocker arm and which is shown schematically in FIG. 1, with a channel 21 (FIG. 2) in the rocker arm shaft 3 and thus communicates with the ordinary engine lubrication system. The valve arrangement 20 comprises a controlled check valve 22, which has a valve element in the form of a ball 23, which is biased against a seat 24 by a spring 25. On the opposite side of the ball there is a chamber 26 which contains a control piston 27 with a stem 28, the distal end of which faces the ball 23. The control piston 27 is biased by a spring 29 with greater force than the one-way valve spring 25, which means that the stem 28 at normal lubricating oil pressure, circa 1 bar, will keep the ball 23 lifted from its seat so that the cylinder chamber 7 is normally in communication with the engine lubrication system via the check valve 22. In FIG. 1, a conduit 30 symbolizes the connection to the channel 21 (FIG. 2) in the rocker arm shaft 3. A branch conduit 31 leads, on the one hand, to the chamber 26 of the control piston 27 and, on the other hand, to a chamber 32 containing a piston 34 loaded by a spring 33 and which forms a pressure accumulator.

During normal operation, i.e. in drive mode, said pressure of approximately 1 bar will prevail in the rocker arm shaft, which means that the check valve 22 will be open and the piston element 8 will be in its retracted end position against the bottom 13 of the cylinder chamber 7. Normal valve play will now prevail in the valve mechanism.

In the transition to brake mode, the pressure in the rocker arm shaft increases to circa 2 bar, and the control element 27 will retract to the position shown in FIG. 1, in which the spring 25 biases the ball 23 against the seat 24 and closes the check valve 22. Oil flowing into the cylinder chamber 7 now presses the piston element out to the valve play take-up position shown in FIG. 1. The cam element 5, which in addition to the ordinary lift lobe 5*a*, is provided in a known manner with a pair of extra lobes 5*b*,5*c*, of which the lobe 5*c* is a so-called pressure lowering lobe, will now via the latter open the exhaust valve so much at the end of the compression stroke as corresponds to the taken-up valve play.

Figure 4:
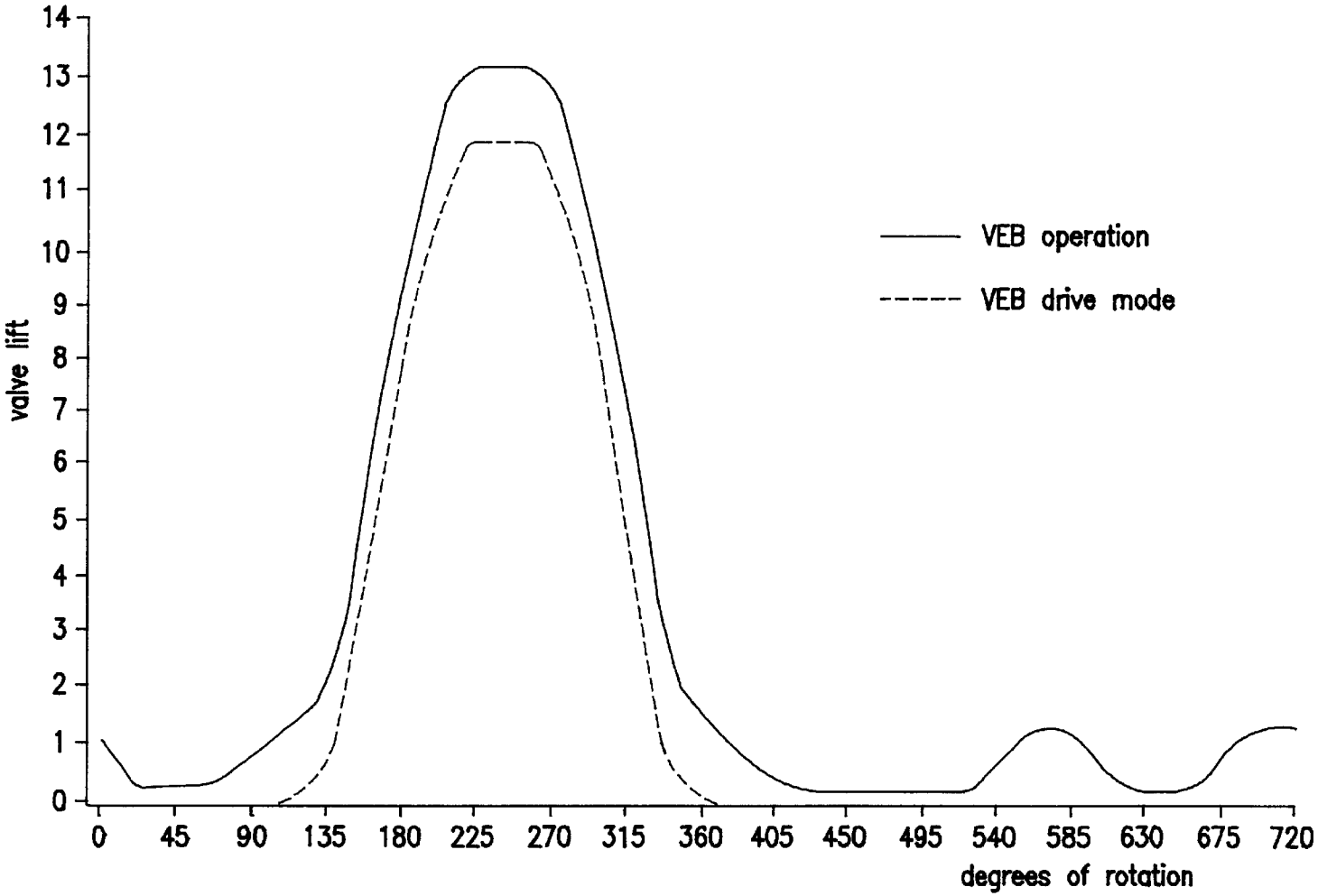
FIG. 4 PRIOR ART
FIG. 4 is a diagram illustrating the exhaust valve lift curves for an engine with the known valve mechanism described in the preamble.

What has been described up to now regarding the function belongs to the prior art for increasing the engine braking power by seeing to it that only a minimal portion of the piston compression work can be recovered during the expansion stroke. FIG. 4 shows the valve lift curves for drive mode and brake mode, and from these curves it is evident that the maximum lift for an engine with the described engine braking arrangement must be lower than in a corresponding engine without such an engine braking arrangement where maximum lift can be utilized for drive mode.

Figure 3:
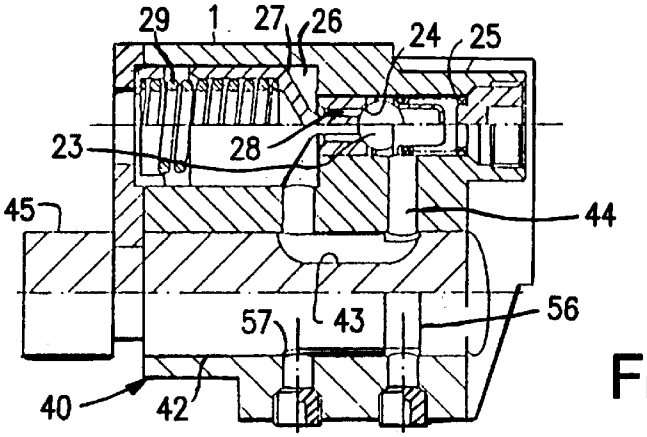
FIG. 3 is a longitudinal section along the line III—III in FIG. 2.
Figure 5:
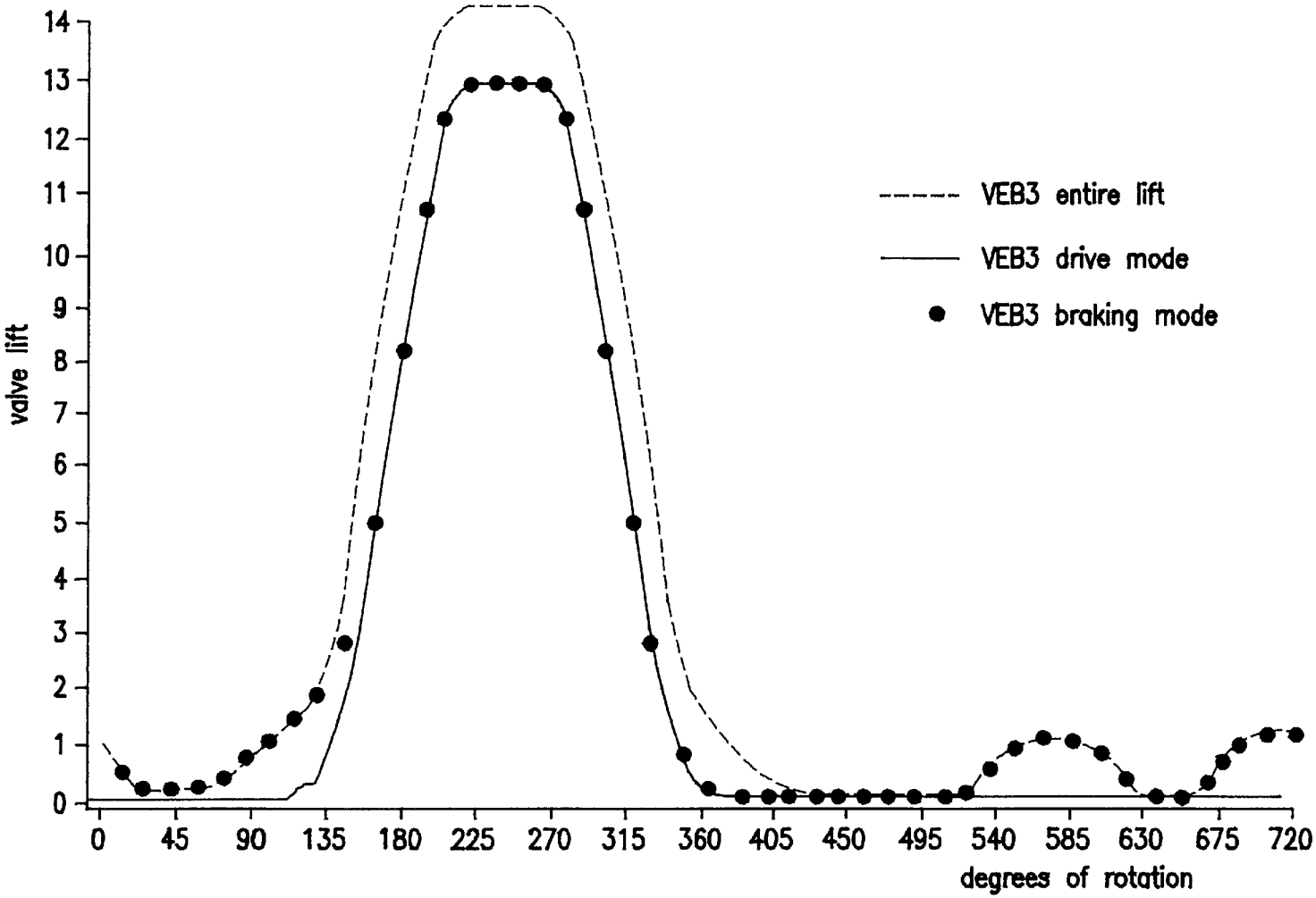
FIG. 5 is a diagram illustrating the exhaust valve lift curves for an engine with an exhaust valve mechanism according to the invention.

In order to make use of maximum lift, particularly in the vicinity of closing even in drive mode, the exhaust valve mechanism according to the invention is supplemented with a bypass valve, generally designated 40, which consists of a valve slide 42 rotatably mounted in the rocker arm 1 and having a groove 43, which in one position of the slide 42 (see FIGS. 1 and 3) connects a channel 44 from the cylinder chamber 7 to the chamber 26 of the control piston and consequently, via the channel 30, also to the engine lubrication system. The valve slide 42 is provided at one end with a gear rim 45 which engages the gears of a gear sector 46 (see FIG. 2) fixed in relation to the rocker arm shaft 3. This means that the valve slide 42 will rotate back and forth in the bore 41 as the rocker arm 1 rocks and that the groove 43 will, once per cycle "shortcircuit" the communication over the check valve 22, so that oil can be pressed out from the cylinder chamber 7 and the piston 8 will go to the bottom of the cylinder chamber even in braking mode. The gear rim 45 and the gear sector 46 are so adapted to each other that the slide 42 is rotated to the shortcircuiting position after the pressure reducing lobe 5*c* has passed the rocker arm cam roller 4, so that the piston 8 will be at the bottom position before the cam roller 4 reaches the top of the ordinary lift lobe 5*a*. In a practical embodiment with a rocker arm with a 12° rocking movement, the valve slide will shortcircuit after approximately 5° of rocking movement, i.e. at approximately 150 degrees of rotation, as illustrated in FIG. 5, where the dashed curve shows the maximum (impermissible) lift if the valve play take-up piston 8 should remain in its extended position over an entire operational cycle. The solid curve is the lift curve for drive mode, where the dotted curve is the lift curve for braking mode. The dotted braking mode curve passes, due to the described bypass function, at approximately 150 degrees of rotation, from the maximum curve to the drive mode curve.

Evacuation takes place very rapidly under the influence of the force exerted on the piston 8 by the valve springs, which can exert a momentary pressure in the system of circa 20–25 bar. In a multi-cylinder engine, the rapid evacuation of the valve play take-up cylinder chamber 7 in the exhaust valves in one cylinder provides sufficient time to fill the cylinder chamber 7 in the exhaust valves in other cylinders. In an engine with few cylinders, it is not possible to adapt the time for evacuating a valve play take-up device for one cylinder to the filling of one or more valve play take-up devices for other cylinders. In this case the pressure accumulator 32,33, 34, together with the chamber 26 of the control piston 27, has the task of taking care of the pressure oil upon evacuation of the cylinder chamber 7, and in a charged state in the subsequent cycle seeing to it that the refilling occurs rapidly. A check valve 47 in the conduit 30 guarantees the charging. In an engine with many cylinders, the pressure accumulator 32,33,34 and the check valve 47 can be eliminated since the pressure accumulator function in principle is assumed by the valve play-compensating devices of the other cylinders, as was stated above.

The piston element 8 is provided in a known manner, with a cavity 50 which communicates with the cylinder chamber 7 via a channel 51, one end of which forms a valve seat 52 for a valve body in the form of a ball 53, which is biased by a spring 54. The components 52,53,54 form a relief valve which, at a predetermined pressure in the cylinder 7, is opened to allow oil to be drained via the channels 55 in the piston element 8. The grooves 43 in the valve slide 42 communicate via a ring channel 56 with one or more shallow grooves 57 (one shown) on that side of the slide which is opposite to the groove 43 in order to equalize the radial forces acting on the slide through the oil pressure in the groove 43.

We claim:

1. Exhaust valve mechanism in an internal combustion engine, comprising at least one exhaust valve in each cylinder, for each cylinder a rocker arm mounted on a rocker arm shaft for operating the exhaust valve, a cam shaft with a cam element for each rocker arm, said cam element cooperating with a cam follower at one end of the rocker arm, a valve play take-up device arranged between an opposite end of the rocker arm and the exhaust valve, said valve play take-up device comprising a piston element received in a cylinder chamber disposed in said opposite rocker arm end, and a hydraulic circuit with valve means for supplying or draining hydraulic oil to and from said cylinder chamber, said valve means comprising a controlled check valve, which at a certain low pressure permits flow of oil from the cylinder chamber, characterized in that the valve means (20) comprise valve means (40) controlled relative to the rocking movement of the rocker arm (1), said valve means being disposed, after a certain rocking movement, to open a communication (43) past the check valve (22) to permit drainage of the cylinder chamber (7).

2. Valve mechanism according to claim 1, characterized in that said valve means (40) are carried by the rocker (1) and that interengaging transmission means (45,46) joined to the rocker arm shaft (3) and the valve means (40), respectively, are arranged to reset the valve means depending on the rocking movement of the rocker arm.

3. Valve mechanism according to claim 2, characterized in that the valve means (40) comprise a valve slide (42) rotatably mounted in a bore (41) in the rocker arm (1), said slide having a gear rim (45) in engagement with a gear sector (46) fixed relative to the rocker arm shaft (3) and a groove (43) which, in one position of the valve slide, permits drainage of the cylinder chamber (7) past the check valve (22).

4. Valve mechanism according to claim 3, characterized in that the groove (43), via an annular slot (56), communicates with at least one diametrically opposite groove (57) for pressure relief of the slide.

5. Valve mechanism according to claim 1, characterized in that the hydraulic circuit contains a pressure accumulator (32, 33, 34), which is disposed to be charged by the oil which is drained from the cylinder chamber (7).

* * * * *